US007415225B2

(12) United States Patent
Inada

(10) Patent No.: US 7,415,225 B2
(45) Date of Patent: Aug. 19, 2008

(54) IMAGE FORMING APPARATUS

(75) Inventor: Ken Inada, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 253 days.

(21) Appl. No.: 11/449,647

(22) Filed: Jun. 9, 2006

(65) Prior Publication Data

US 2006/0280520 A1 Dec. 14, 2006

(30) Foreign Application Priority Data

Jun. 13, 2005 (JP) ..... 2005-171783

(51) Int. Cl.
*G03G 15/08* (2006.01)

(52) U.S. Cl. ..... 399/121; 399/122

(58) Field of Classification Search ..... 399/16, 399/21, 107, 121, 122, 123, 124
See application file for complete search history.

(56) References Cited

U.S. PATENT DOCUMENTS 4,990,966 A * 2/1991 Sindo ..... 399/124
5,606,406 A * 2/1997 Ikeyama et al. ..... 399/111

FOREIGN PATENT DOCUMENTS

JP 2002-072819 3/2002

* cited by examiner

*Primary Examiner*—Hoan H Tran
(74) *Attorney, Agent, or Firm*—Smith, Gambrell & Russell, LLP

(57) ABSTRACT

A fixing unit 8 is fitted with a rail 28 along which a rail guide provided inside an image forming apparatus can slide. This allows the fixing unit 8 to be extracted out of the image forming apparatus. When the fixing unit 8 is extracted out of the image forming apparatus, a transferring body separating member 26, which has thus far been prevented from rotating by the rail 28, is made to rotate by the force applied by a tension spring 27. An end portion of the transferring body separating member 26 presses a transfer roller bracket 24 and thereby moves a transfer roller 17. Thus, the transfer roller 17 is separated from a photoconductor drum 2.

28 Claims, 8 Drawing Sheets

IMAGE FORMING APPARATUS

This application is based on Japanese Patent Application No. 2005-171783 filed on Jun. 13, 2005, the contents of which are hereby incorporated by reference.

BACKGROUND OF THE INVENTION

1. Field of the Invention

The present invention relates to an image forming apparatus such as a digital copier or laser printer, and more particularly to a jam disposal mechanism that allows a paper jam to be disposed of from the side of a fixing unit.

2. Description of Related Art

The construction of a conventional image forming apparatus is shown in FIG. 8. Reference numeral 100 represents an image forming apparatus, which is here assumed to be a digital multifunctional product, for example. When the image forming apparatus 100 performs a copying operation, in an image forming section P arranged above a conveying belt 9 inside the cabinet of the multifunctional product, steps of charging, exposure, development, and transferring are performed to form a predetermined image based on original image data read by an image reading section 6.

In the image forming section P, a photoconductor drum 2 for carrying a visible image (toner image) is arranged. The toner image formed on the photoconductor drum 2 is transferred to a sheet (recording medium) 7 carried and conveyed by a transfer belt 9 that moves adjacently to the image forming section P. The transferred toner image is then fixed on the sheet 7 in a fixing unit 8, and is then ejected out of the cabinet of the apparatus. While the photoconductor drum 2 is rotated clockwise (in the direction indicated by arrow A) as viewed in FIG. 8, an image forming process is performed with respect to the photoconductor drum 2.

Next, the image forming section P will be described in detail. The photoconductor drum 2 is arranged so as to be freely rotatable. Around and above the photoconductor drum 2, there are provided: a charger 3 for electrically charging the photoconductor drum 2, an exposure unit 4 for exposing the photoconductor drum 2 to light representing image information; a developer unit 5 for forming a toner image on the photoconductor drum 2; and a cleaning section 10 for removing developing agent (toner) that remains on the photoconductor drum 2.

The surface of the photoconductor drum 2 is first electrically charged uniformly by the charger 3, and is then exposed to light by the exposure unit 4 so that an electrostatic latent image according to an image signal is formed on the photoconductor drum 2. The developer unit 5 is loaded with a predetermined amount of toner by a toner container 11. This toner is fed by the developer unit 5 onto the photoconductor drum 2 so as to be electrostatic ally adhered to the surface thereof, on which a toner image is thus formed according to the electrostatic latent image formed through the exposure by the exposure unit 4.

The sheet 7 to which the toner image is transferred is housed in a sheet housing section 12, which is composed of a plurality of paper feed cassettes 12*a*, 12*b*, and 12*c* and a stack bypass (hand-feed tray) 12*d* provided above them. The sheet is fed via paper feed rollers 13 and resist rollers 14 onto the conveying belt 9 so as to be conveyed into position on the photoconductor drum 2. The paper feed cassettes 12*a*, 12*b*, and 12*c* are detachably attached to the apparatus cabinet 1.

The conveying belt 9 is hung around and between a drive roller 15, disposed downstream, and a follower roller 16, disposed upstream. When the conveying belt 9 starts to rotate counter-clockwise, the sheet 7 is conveyed via the resist rollers 14 onto the conveying belt 9. At this time, an image write signal turns on, so that an image is formed on the photoconductor drum 2 with predetermined timing.

Under the photoconductor drum 2, a transfer roller 17 is arranged to which a predetermined transfer voltage is applied. At the nip between the photoconductor drum 2 and the transfer roller 17, the toner image on the photoconductor drum 2 is transferred to the sheet 7. The sheet 7 is held on the conveying belt 9 by electrostatic attraction. The conveying belt 9 is formed of a dielectric resin sheet, and is built as an endless or seamless belt by joining together opposite ends of such a sheet.

The sheet 7 having the toner image transferred thereto is separated from the conveying belt 9, and is conveyed to the fixing unit 8. On the other hand, after the transfer of the toner image, the photoconductor drum 2 is cleaned by the cleaning section 10 so that the toner that remains on the surface of the photoconductor drum 2 is removed in preparation for the subsequent formation of a new electrostatic latent image. Conveyed from the conveying belt 9 to the fixing unit 8, the sheet 7 is then heated and pressed by a pair of fixing rollers 8*a* and 8*b* so that the toner image is fixed on the surface of the sheet 7 to form a predetermined image. Having the image formed thereon, the sheet 7 then passes via pairs of conveying rollers 18 and 19, and is then ejected by a pair of ejection rollers 20 onto an ejected paper tray 21.

Although not illustrated, a charge removing device for removing the residual electric charge on the surface of the photoconductor drum 2 is provided on the downstream side of the cleaning section 10. Reference numeral 22 represents a cover provided on a side face of the apparatus cabinet 1. The cover 22 is so built as to be freely openable and closable in the direction indicated by arrow B about a pivot 23. Opening this cover 22 allows simple maintenance work, such as removable of a paper jam.

In the image forming apparatus constructed as described above, if the sheet 7 is stuck in the middle of image formation and causes a paper jam, for example, extracting the fixing unit 8 out of the apparatus cabinet 1 parallel to the paper conveying direction (that is, leftward in FIG. 8) makes it possible to dispose of the paper jam. Inconveniently, however, doing so involves pulling out the sheet 7 held between the photoconductor drum 2 and the transfer roller 17, and this may cause various problems, such as the sheet 7 breaking, or the unfixed toner splashing and soiling the interior of the apparatus.

To overcome this inconvenience, for example, JP-A-2002-72819 proposes an intermediary-transfer-type image forming apparatus wherein at least a secondary transferring member and fixing means are held with a holding member and wherein this holding member is so built as to be freely extractable in a direction that points away from the image forming apparatus and that coincides with the paper ejection direction. Certainly, this makes it possible to remove a jammed sheet without breaking it or soiling the interior and exterior of the apparatus with unfixed toner.

With the technique disclosed in JP-A-2002-72819 mentioned above, however, it is necessary to provide a holding member for holding at least the fixing unit 8 and the transfer roller 17. In this case, for the holding member to be able to hold the fixing unit 8 and the transfer roller 17, the holding member itself needs to be considerably large. Disadvantageously, this unduly increases the size and cost of the image forming apparatus. Moreover, to dispose of a paper jam, it is necessary to extract the holding member along with the fixing unit 8 and the transfer roller 17 it holds. Disadvantageously, this requires a wider work space than extracting the fixing unit 8 alone.

SUMMARY OF THE INVENTION

In view of the conventionally experienced inconveniences and disadvantages mentioned above, it is an object of the present invention to provide a compactly and simply constructed image forming apparatus that allows jam disposal with a minimum work space, without breakage of the jammed sheet, and without splashing of unfixed toner.

To achieve the above object, according to the present invention, an image forming apparatus is provided with: an image carrying body; a transferring body for transferring a toner image formed on the image carrying body to a sheet; first force applying means for keeping the transferring body in pressed contact with the image carrying body at a predetermined angle; a fixing unit for fixing the toner image transferred to the sheet by the transferring body, the fixing unit being so arranged as to be extractable substantially parallel to a paper conveying direction in order to allow jam disposal; and a transferring body separating member that, as the fixing unit is extracted, selectively takes one of a first position where the transferring body separating member separates the transferring body from the image carrying body against the force applied by the first force applying means and a second position where the transferring body separating member keeps the transferring body in pressed contact with the image carrying body.

With this construction, on the occasion of jam disposal, as the fixing unit is extracted, the transferring body is separated from the image carrying body, and thus the jammed sheet is prevented from being forcibly pulled out. This allows jam disposal without breakage of the jammed sheet, and without splashing of toner and hence without soiling of the interior and exterior of the apparatus. Moreover, this jam disposal mechanism does not require a large component. This helps avoid increasing the size of the apparatus, and allows jam disposal without requiring a wide work space.

According to the present invention, in the image forming apparatus described above, the transferring body separating member separates the transferring body from the image carrying body in a direction substantially opposite to the direction in which the first force applying means applies the force.

With this construction, the transferring body separating member allows the transferring body to move only in a predetermined direction. Thus, the introduction of the jam disposal mechanism does not impose an undue burden on the image forming apparatus.

According to the present invention, in the image forming apparatus described above, the transferring body separating member is coupled to a second force applying means that applies to the transferring body a force that causes the transferring body to tend to move apart from the image carrying body, and the force applied by the second force applying means is stronger than the force applied by the first force applying means. Here, as the fixing unit is extracted, the second force applying means makes the transferring body separating member move into the first position.

With this construction, it is possible to realize a simply constructed jam disposal mechanism by the use of force applying means.

According to the present invention, in the image forming apparatus described above, the transferring body separating member is so supported as to be rotatable about an axis parallel to the rotation axis of the transferring body. Here, the transferring body separating member is coupled to a second force applying means that applies to the transferring body separating member a force that causes the transferring body separating member to tend to move to the first position, and the force applied by the second force applying means is so set that, when the transferring body separating member moves to the first position, the moment of the force that the second force applying means applies to the transferring body separating member is greater than the moment of the force that the first force applying means applies to the transferring body separating member. As the fixing unit is extracted, the force applied by the second force applying means makes the transferring body separating member rotate to move into the first position.

With this construction, the transferring body separating member can be rotated with the force applying means. Thus, it is possible to realize a simply constructed jam disposal mechanism.

According to the present invention, in the image forming apparatus described above, the fixing unit is fitted with a rail that allows the fixing unit to be extracted. Here, when the fixing unit is not extracted, the transferring body separating member makes contact with an end of the rail so as to be held in the second position and, when the fixing unit is extracted, the transferring body separating member loses contact with the end of the rail so as to move to the first position.

With this construction, the jam disposal mechanism in which the transferring body separating member is operated as the fixing unit is extracted can be built by sharing an existing component. This helps minimize the increase in the number of components, and helps give the apparatus a simple construction.

According to the present invention, the image forming apparatus described above is further provided with: driving means for driving the transferring body separating member; detecting means for detecting whether or not the fixing unit is extracted; and a control section for controlling the driving means based on a detection signal from the detecting means. Here, based on the detection signal, the control section places the transferring body separating member selectively in one of the first and second positions.

With this construction, it is possible to realize a jam disposal mechanism in which the transferring body separating member can be operated electrically.

According to the present invention, in the image forming apparatus described above, the transferring body separating member moves to the first position while pressing part of a bracket portion supporting the transferring body.

With this construction, it is possible to provide the jam disposal mechanism without imposing an undue burden on the image forming apparatus. Moreover, it is possible to exploit an existing component and thereby to avoid an undue increase in the number of components.

DETAILED DESCRIPTION OF PREFERRED EMBODIMENTS

Figure 8:
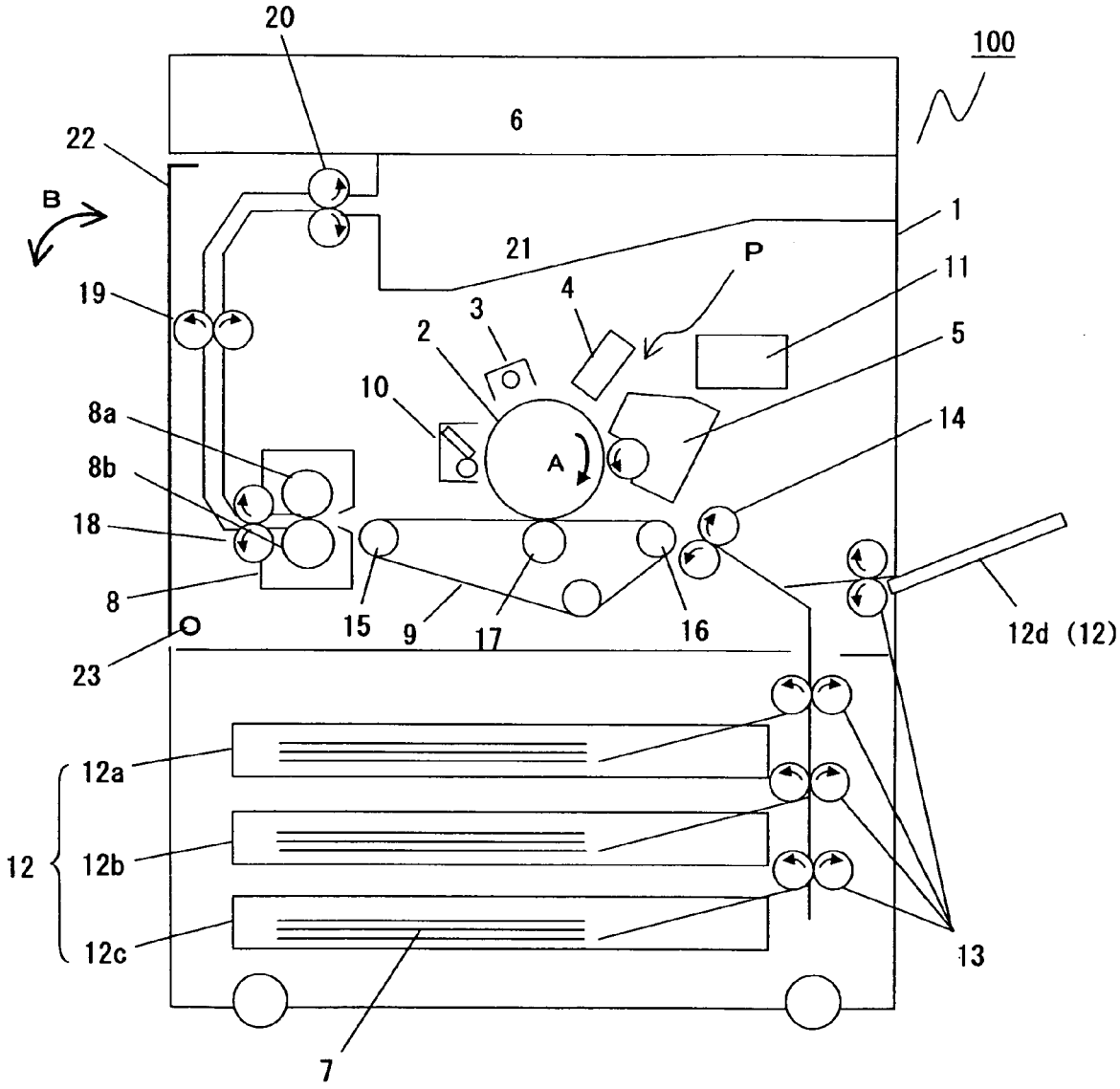
Fig. 8 PRIOR ART
FIG. 8 is a schematic sectional view showing a conventional image forming apparatus.

Hereinafter, embodiments of the present invention will be described with reference to the accompanying drawings. First, the image forming apparatus of a first embodiment of the invention will be described. It should be noted that such parts as are found also in the conventional image forming apparatus 100 (see FIG. 8) are identified with common reference numerals, and no description thereof will be repeated unless necessary.

Figure 1:
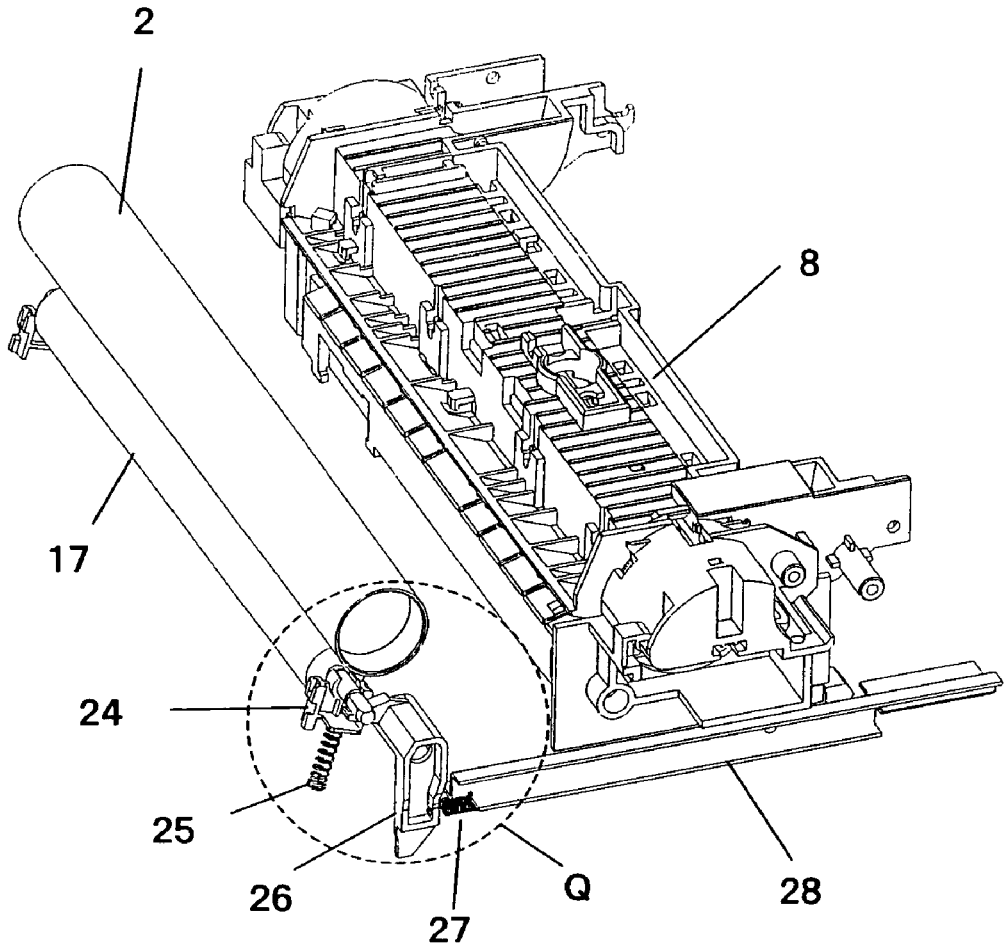
FIG. 1 is a schematic perspective view showing the relationship among the photoconductor drum, the transfer roller, and the fixing unit in the image forming apparatus of a first embodiment of the present invention.

FIG. 1 is a schematic perspective view showing the relationship among the photoconductor drum (image carrying body) 2, the transfer roller (transferring body) 17, and the fixing unit 8 in the image forming apparatus of a first embodiment of the present invention. In FIG. 1, the fixing unit 8 is housed inside the image forming apparatus. As shown in FIG. 1, the fixing unit 8 is arranged at a predetermined distance from the photoconductor drum 2 and the transfer roller 17. Moreover, to allow the fixing unit 8 to be extracted out of the image forming apparatus in a direction that is substantially parallel to the paper conveying direction, the fixing unit 8 is fitted with a rail 28. The rail 28 is so supported as to be slid able along a rail guide (unillustrated) provided inside the image forming apparatus.

Figure 2:
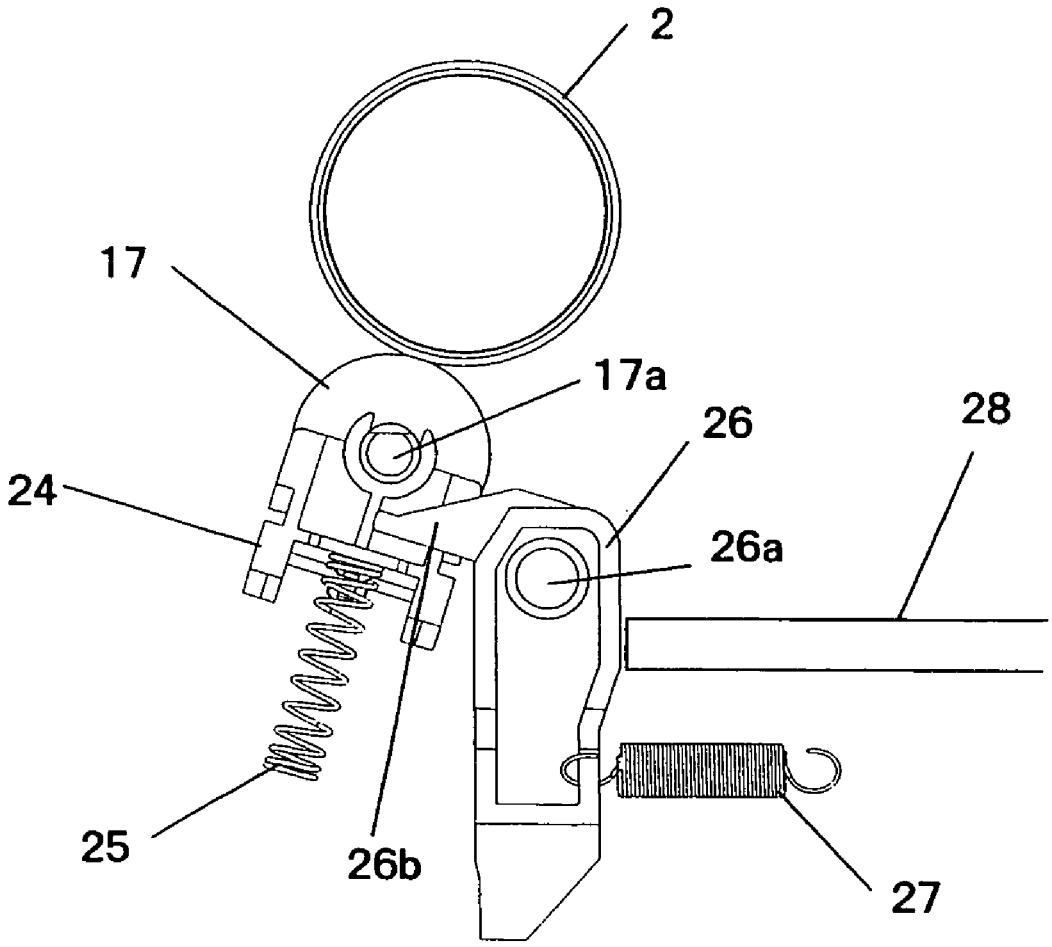
FIG. 2 is an enlarged front view, as seen in the direction of the axis of the transfer roller, of and around the transferring body separating member in the image forming apparatus of the first embodiment.

FIG. 2 is a front view of part Q indicated by a broken-line circle in FIG. 1, as seen in the direction of the transfer roller 17. The photoconductor drum 2 and the transfer roller 17 are arranged perpendicular to the plane of the figure. The transfer roller 17 is supported on a transfer roller bracket 24. To this transfer roller bracket 24, a force is applied by a transfer spring (for example, a compression spring, serving as first force applying means) 25. This keeps the transfer roller 17 pressed onto the photoconductor drum 2 at a predetermined angle.

Reference numeral 26 represents a transferring body separating member, the use of which facilitates jam disposal in the image forming apparatus. The transferring body separating member 26 has a shaft 26*a* parallel to the shaft 17*a* of the transfer roller 17, and is rotatable about the shaft 26*a*. As shown in FIG. 2, the transferring body separating member 26 is fitted, under the shaft 26*a*, with a tension spring (serving as second force applying means) 27, of which the other end is fixed. Thus, to the transferring body separating member 26, a force is applied that causes it to tend to move rightward in the figure.

So long as the fixing unit 8 is housed inside the image forming apparatus, however, the rail 28 provided on the fixing unit 8 keeps contact with the transferring body separating member 26, and thereby prevents the transferring body separating member 26 from rotating. Thus, irrespective of the force applied by the tension spring 27, the transferring body separating member 26 remains unmovable, and an end portion 26*b* of the transferring body separating member 26 is kept apart from the transfer roller bracket 24.

Figure 3:
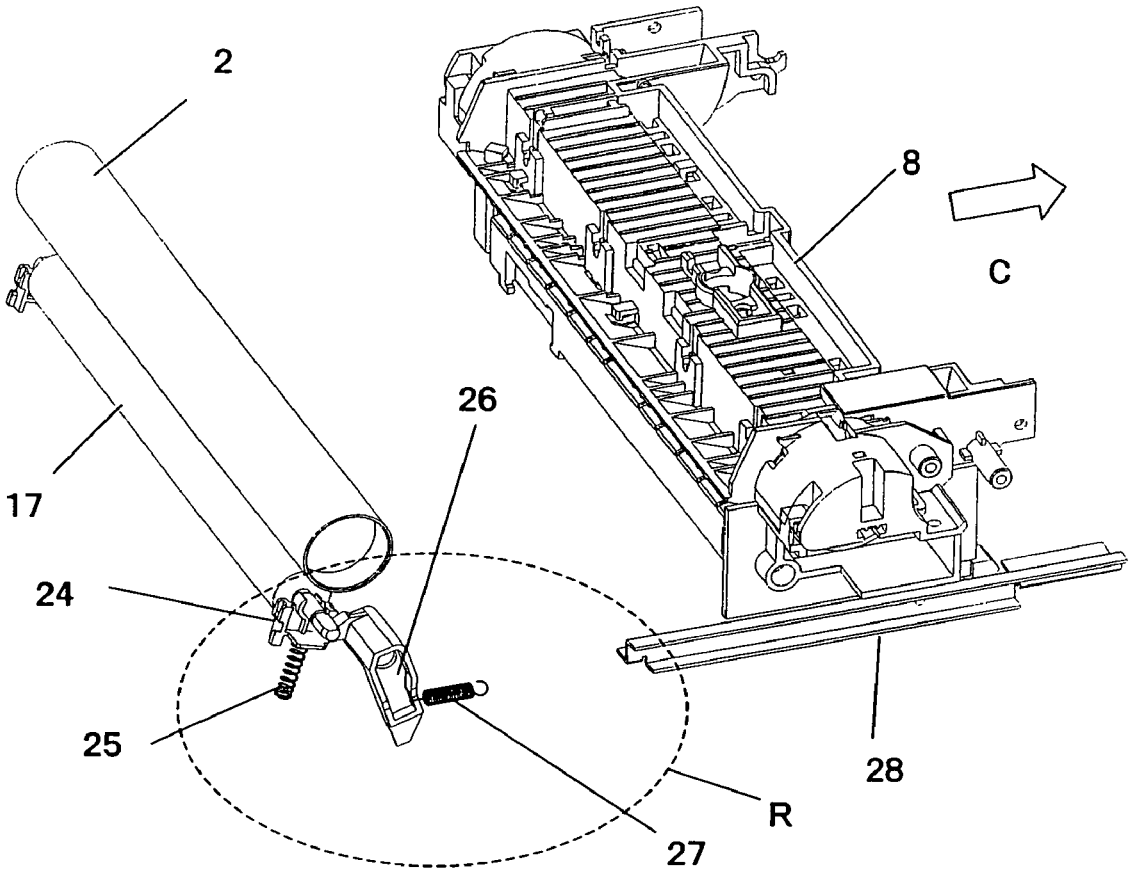
FIG. 3 is a schematic perspective view of the fixing unit shown in FIG. 1, in a state extracted out of the image forming apparatus.

Next, the operation of the transferring body separating member 26 when the fixing unit 8 is extracted out of the image forming apparatus will be described. FIG. 3 is a schematic perspective view showing the relationship among the photoconductor drum 2, the transfer roller 17 and the fixing unit 8 when the fixing unit 8 is extracted out of the image forming apparatus. Here, the fixing unit 8 has been extracted in the direction indicated by arrow C shown in FIG. 3. When the fixing unit 8 is extracted out of the image forming apparatus, the transferring body separating member 26 operates as shown in FIG. 4.

Figure 4:
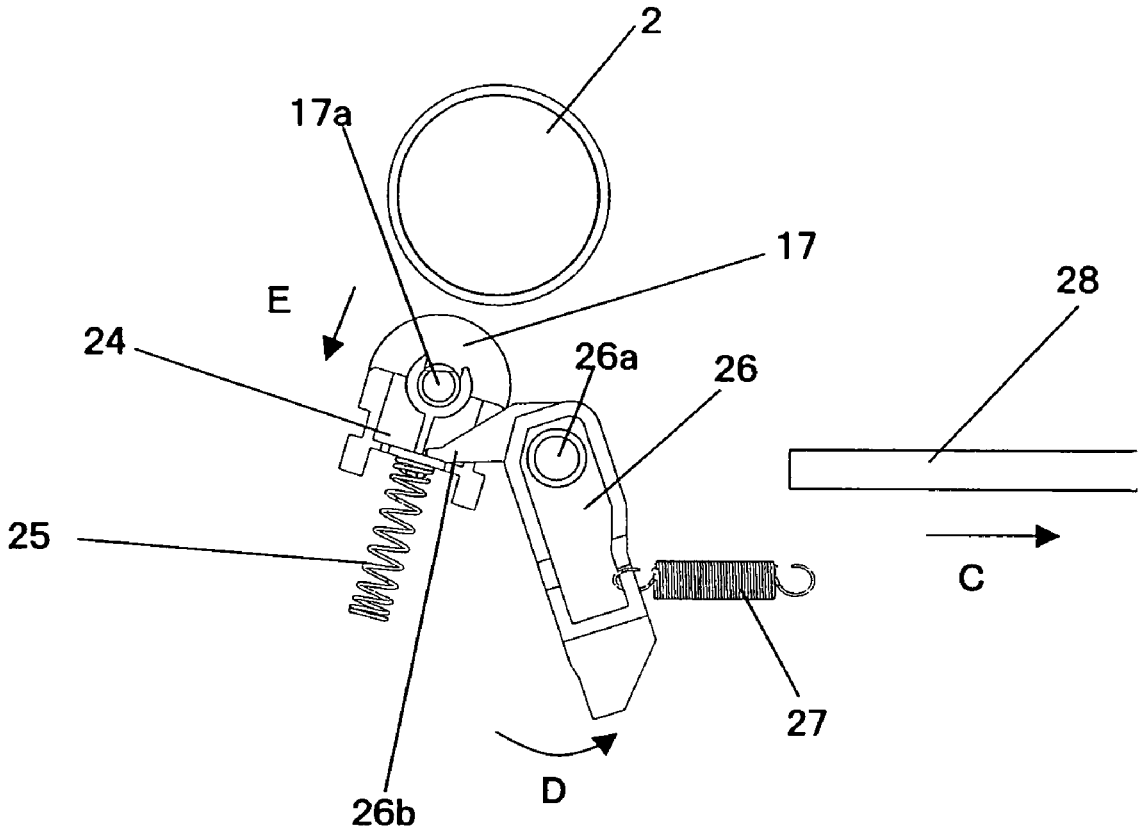
FIG. 4 is a schematic diagram showing the transferring body separating member shown in FIG. 2, in an operated state.

FIG. 4 is a front view of part R indicated by a broken-line ellipse in FIG. 3, as seen in the direction of the axis of the transfer roller 17. As a result of the fixing unit 8 being extracted out of the image forming apparatus, the rail 28 moves rightward (in the direction indicated by arrow C) in the figure. Now, the transferring body separating member 26 is liberated from the restriction of movement by the rail 28. Thus, the force applied by the tension spring 27 causes the transferring body separating member 26 to rotate in the direction indicated by arrow D in the figure about the shaft 26*a*. As the transferring body separating member 26 rotates, an end portion 26*b* thereof hits the transfer roller bracket 24 and then moves it in a direction (the direction indicated by arrow E in the figure) substantially opposite to the direction in which the transfer spring 25 applies the force to the transfer roller bracket 24.

Here, since the transfer roller bracket 24 receives the force applied by the transfer spring 25, the force applied by the tension spring 27 needs to be so set that, when the transferring body separating member 26 rotates, the moment of the force that the tension spring 27 applies to the transferring body separating member 26 is greater than the moment of the force that the transfer spring 25 applies to the transferring body separating member 26.

In the construction described above, when the fixing unit 8 is extracted out of the image forming apparatus, the photoconductor drum 2 and the transfer roller 17 are located at a predetermined distance from each other. Thus, when a paper jam is disposed of with the fixing unit 8 extracted, the jammed sheet is prevented from being pulled out while it is held between the photoconductor drum 2 and the transfer roller 17. In this way, it is possible to dispose of a paper jam without breaking the jammed sheet, and without splashing the unfixed toner developed on the sheet by the transfer roller 17 and hence without soiling the interior of the apparatus etc.

On the other hand, when the fixing unit 8 is housed back inside the image forming apparatus, the transferring body separating member 26 is pushed by the rail 28 so as to be rotated, in the direction opposite to arrow D in FIG. 4, out of contact with the transfer roller bracket 24. Since the transfer roller bracket 24 receives the force applied by the transfer spring 25, it is pushed up in the direction (opposite to the direction indicated by arrow E in FIG. 4) in which it receives the applied force. This brings the transfer roller 17 back into contact with the photoconductor drum 2, restoring the state before the fixing unit 8 is extracted.

In this embodiment, as the transferring body separating member 26 rotates, the transfer roller 17 is brought apart from the photoconductor drum 2. This, however, is not meant as any limitation, and many modifications and variations are possible within the object of the present invention. For example, the transfer roller 17 may be brought apart form the photoconductor drum 2 without rotating the transferring body separating member 26. Specifically, the image forming apparatus may be constructed, for example, as follows.

Figure 5A:
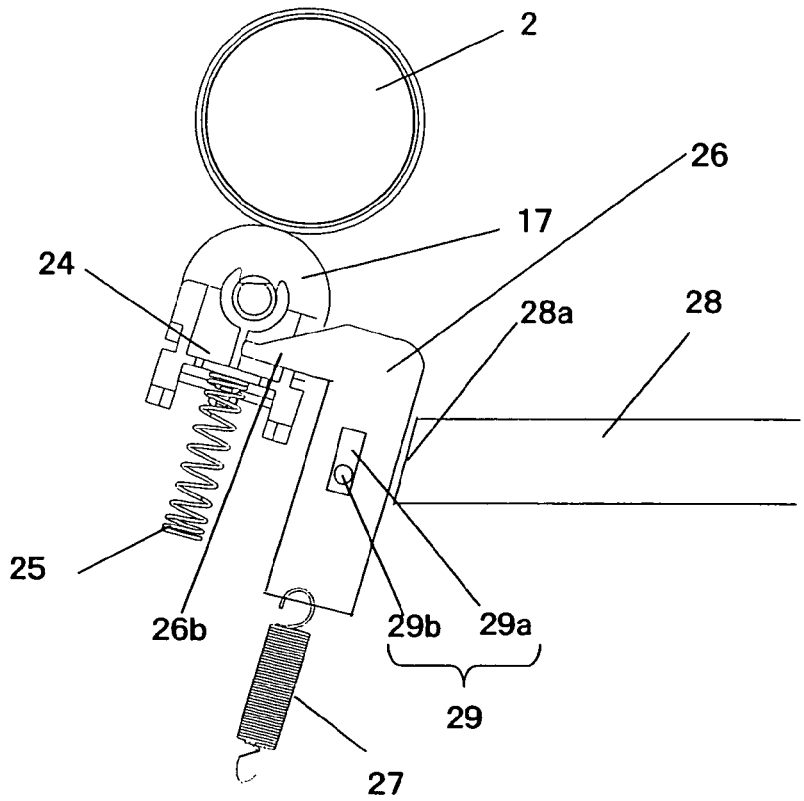
FIG. 5A is a schematic front view illustrating the construction of and around the transferring body separating member in the image forming apparatus of a second embodiment of the present invention, in a state in which the fixing unit is not extracted out of the image forming apparatus.
Figure 5B:
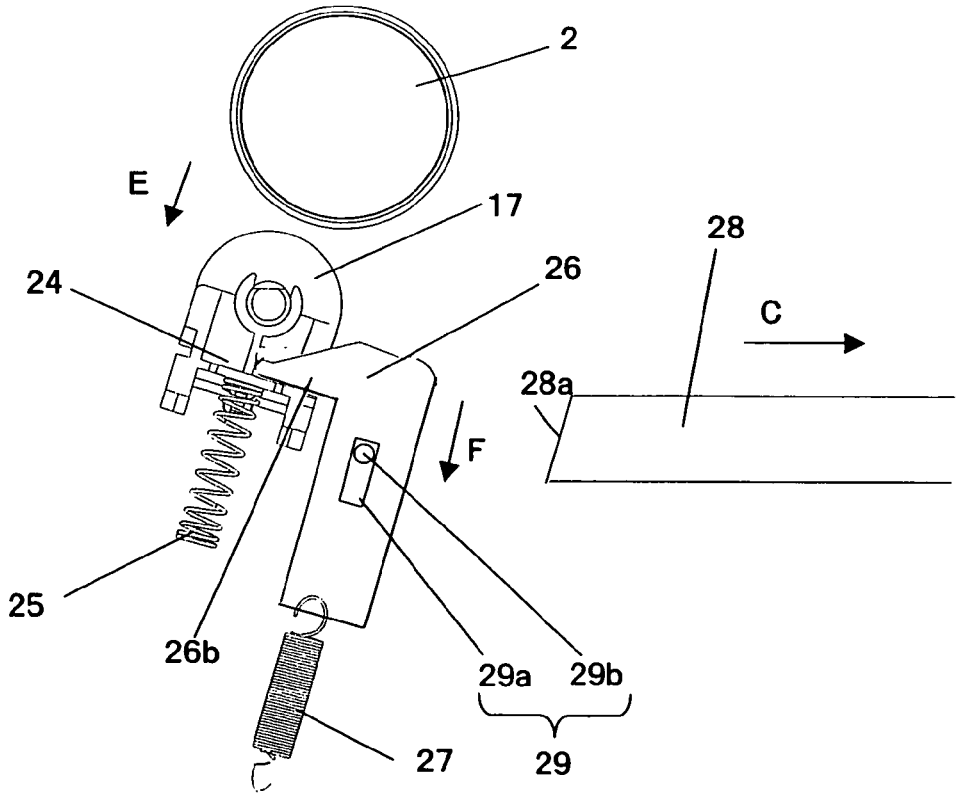
FIG. 5B is a schematic front view illustrating the construction of and around the transferring body separating member in the image forming apparatus of the second embodiment, in a state in which the fixing unit is extracted out of the image forming apparatus.

FIGS. 5A and 5B are schematic front views showing the construction of and around the transferring body separating member 26 in the image forming apparatus of a second embodiment of the present invention, as seen in the direction of the axis of the transfer roller 17, FIG. 5A showing a state in which the fixing unit 8 (see FIG. 1) is not extracted out of the image forming apparatus and FIG. 5B showing a state in which the fixing unit 8 is extracted out of the image forming apparatus. In other respects, the construction here is the same as in the first embodiment, and therefore no overlapping description will be repeated.

The transferring body separating member 26 is fitted with a tension spring 27, of which the other end is fixed to the image forming apparatus. The tension spring 27 applies to the transferring body separating member 26 a force that causes it to tend to move in a direction substantially opposite to the direction in which the transfer spring 25 applies the force to the transfer roller bracket 24. The force applied by the tension spring 27 is set to be stronger than the force applied by the tension spring 27. Also in this embodiment, however, as in the first embodiment, when the fixing unit 8 is not extracted out of the fixing unit 8, the transferring body separating member 26 is prevented from moving by, for example, a rail 28 fitted to the fixing unit 8. Thus, the end portion 26*b* of the transferring body separating member 26 is kept apart from the transfer roller bracket 24.

When the fixing unit 8 is extracted out of the image forming apparatus, the transferring body separating member 26 is liberated from the state locked by the rail 28. Thus, the force applied by the tension spring 27 causes the transferring body separating member 26 to move in the direction indicated by arrow F in FIG. 5B. The end portion 26*b* of the transferring body separating member 26 then hits the transfer roller bracket 24 and then moves it down in the direction indicated by arrow E in the figure. In this way, the transfer roller 17 can be brought apart from the photoconductor drum 2.

In this embodiment, the transferring body separating member 26 is provided with a movement distance limiting mechanism 29. The movement distance limiting mechanism 29 is composed of a limiting hole 29*a* and a pin 29*b* fixed to the apparatus. The movement distance limiting mechanism 29 serves to limit to a predetermined distance the movement distance of the transferring body separating member 26, which is pulled by the force applied by the tension spring 27.

The rail 28, which is fitted to the fixing unit 8, is shaped, in an end portion 28*a* thereof that makes contact with the transferring body separating member 26, to have a predetermined slope. Thus, when the fixing unit 8 is housed back inside the image forming apparatus, the transferring body separating member 26 is pushed up along the slope of the end portion 28*a* of the rail 28 so as to be brought out of contact with the transfer roller bracket 24. Since the transfer roller bracket 24 receives the force applied by the transfer spring 25, it is pushed up in the direction (opposite to the direction indicated by arrow E in FIG. 5B) in which it receives the applied force. This brings the transfer roller 17 back into contact with the photoconductor drum 2, restoring the state before the fixing unit 8 is extracted.

In the embodiments described above, as a member that prevents the movement of the transferring body separating member 26 when the fixing unit 8 is housed inside the image forming apparatus, a rail 28 is used that is fitted to the fixing unit 8. This, however, is not meant as any limitation. In the embodiments described above, as force applying means fitted to the transferring body separating member 26, a tension spring is used. This, however, is not meant as any limitation. For example, a compression spring, a twist coil spring, or the like may be used instead.

The transferring body separating member 26 and the tension spring 27 may be provided at both ends of the transfer roller 17, or at one end thereof. Providing the transferring body separating member 26 and the transfer roller 17 at one end, however, leads to a poor balance when the transfer roller 17 is brought apart from the photoconductor drum 2. This imposes an undue burden on the transfer spring 25 or the like that applies the force to the transfer roller 17, and may cause failure of the apparatus. Thus, it is preferable that the transferring body separating member 26 and the transfer roller 17 be provided at both ends.

In the first and second embodiments described above, the transfer roller 17 is brought apart from the photoconductor drum 2 by designing the transferring body separating member 26 to be movable by force applying means. It is however possible to adopt any other construction within the object of the present invention. For example, it is possible to adopt a construction as described below.

Figure 6:
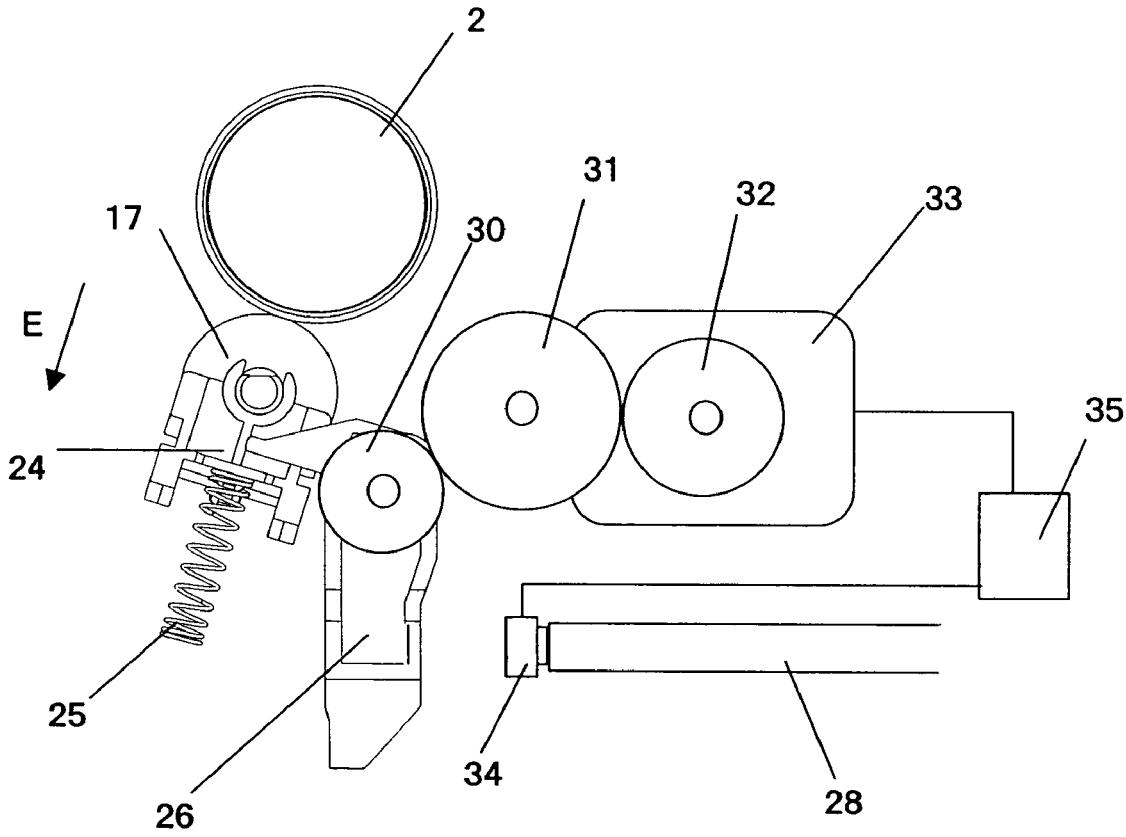
FIG. 6 is a schematic front view illustrating the construction of and around the transferring body separating member in the image forming apparatus of a third embodiment of the present invention.

FIG. 6 is a schematic front view showing the construction of and around the transferring body separating member 26 in the image forming apparatus of a third embodiment of the present invention, as seen in the direction of the axis of the transfer roller 17. In this figure, the fixing unit 8 is housed inside the image forming apparatus. In other respects, the construction here is the same as in the first embodiment, and therefore no overlapping description will be repeated.

The transferring body separating member 26 is fitted with a first gear 30, and the first gear 30 is fitted, via a second gear 31, to a third gear 32, which is fitted to the output spindle of a stepping motor (serving as driving means) 33. When the fixing unit 8 is not extracted out of the image forming apparatus, the rail 28, which is fitted to the fixing unit 8, remains in contact with a pressure sensor (serving as detecting means) 34. The stepping motor 33 and the pressure sensor 34 are connected to the control section 35 of the image forming apparatus.

Figure 7:
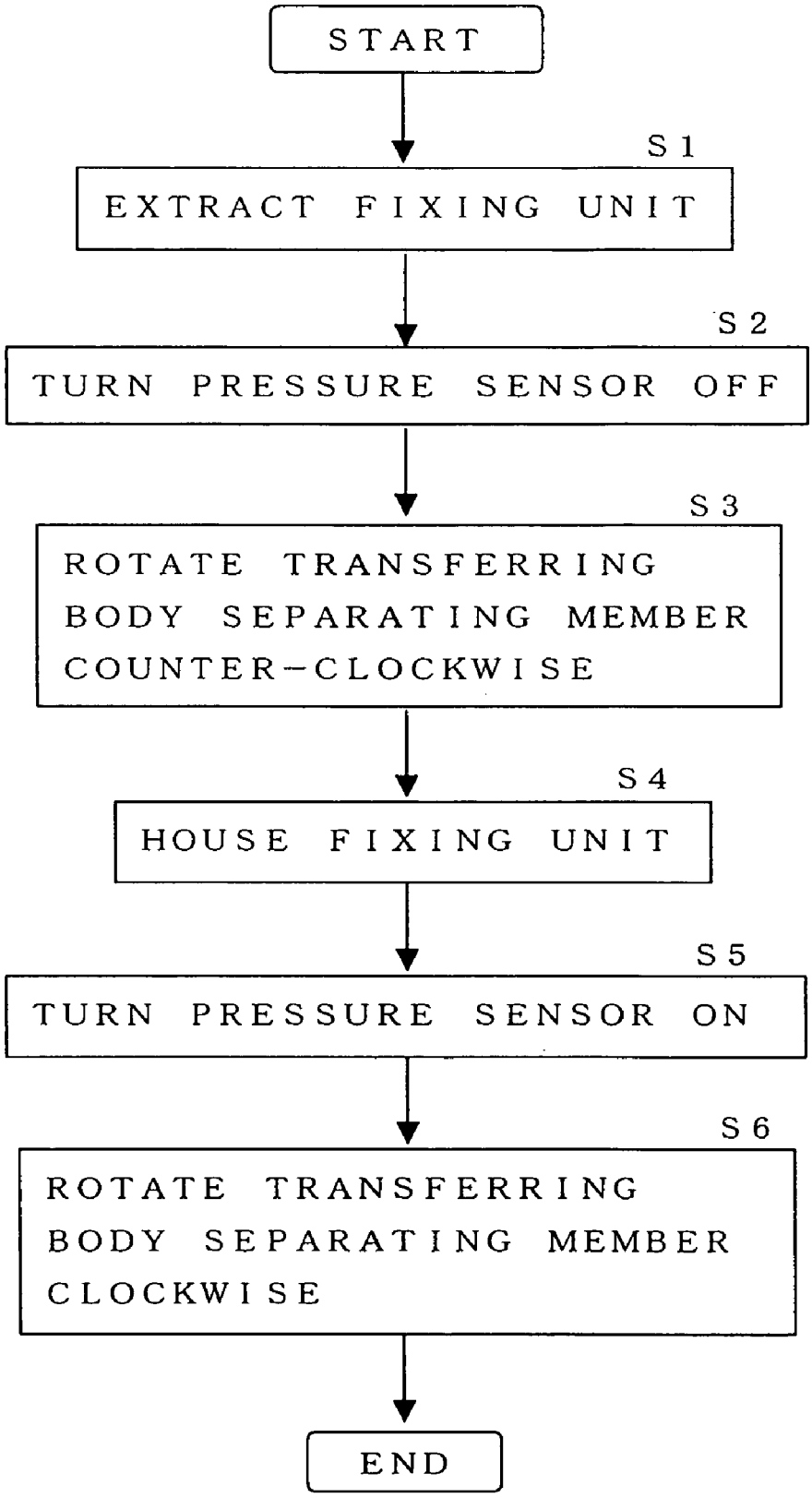
FIG. 7 is a flow chart illustrating the operation of the jam disposal mechanism in the image forming apparatus of the third embodiment.

In the image forming apparatus constructed as described above, jam disposal is performed according to the flow chart shown in FIG. 7. Now, with reference to FIG. 7, the jam disposal operation of the third embodiment will be described. At the start of jam disposal, when the fixing unit 8 is extracted (step S1), the pressure sensor 34 moves apart from the rail 28. Thus, the pressure sensor 34 turns off, and this allows detection of the extraction of the fixing unit 8 (step S2).

According to a detection signal from the pressure sensor 34, the control section 35 instructs the stepping motor 33 to rotate the transferring body separating member 26 by a predetermined among counter-clockwise (step S3). As the transferring body separating member 26 rotates, the transfer roller bracket 24 is pressed down in a direction substantially opposite to the direction in which the transfer spring 25 applies the force to the transfer roller bracket 24. This causes the transfer roller 17 to be separated from the photoconductor drum 2.

On the other hand, on completion of jam disposal, when the fixing unit 8 is housed back inside the image forming apparatus (step S4), the rail 28 is brought back into contact with the pressure sensor 34, and thus the pressure sensor 34 turns on. This allows detection of the fixing unit 8 being housed inside the image forming apparatus (step S5). Then, according to a detection signal from the pressure sensor 34, the control section 35 instructs the stepping motor 33 to rotate the transferring body separating member 26 to rotate clockwise by a predetermined amount (step S6). This brings the transfer roller 17 back into contact with the photoconductor drum 2.

In this embodiment, the transferring body separating member 26 is driven by the use of the stepping motor 33 and the gears 30 to 32. This, however, is not meant as any limitation. For example, it is also possible to adopt a construction in which the transferring body separating member 26 is driven by the use of, for example, a solenoid (serving as driving means). Instead of electrically driving the transferring body separating member 26 as in this embodiment, it is also possible to adopt a construction in which a rack is formed on the rail 28 fitted to the fixing unit 8 so that the transferring body separating member 26 is driven as a result of a gear 30 fitted thereto being rotated to follow the movement of the rack moving along with the fixing unit 8.

All the embodiments described above adopt a construction in which the transferring body separating member 26 presses the transfer roller bracket 24 to move the transfer roller 17. This, however, is not meant as any limitation. The transfer roller 17 has only to be moved as the transferring body separating member 26 moves, and, to achieve this, it is also possible to adopt a construction in which any part other than the transfer roller bracket 24 is pressed to move the transfer roller 17.

The direction in which the transferring body separating member 26 moves the transfer roller 17 apart from the photoconductor drum 2 is not limited to the direction specifically mentioned in connection with the embodiments described above. Since, however, the transfer roller 17 is so restricted as to make contact with the photoconductor drum at a predetermined angle, it is preferable that, as in the embodiments, the transfer roller 17 be moved in a direction substantially opposite to the direction in which the transfer spring 25 applies the force to the transfer roller bracket 24.

According to the present invention, an image forming apparatus provided with an image carrying body that carries image light shone thereat by exposing means, a transferring body that transfers a toner image formed on the image carrying body to a sheet, and a fixing unit that fixes on the sheet the image transferred thereto by the transferring body, wherein the fixing unit is extractable substantially parallel to the paper conveying direction to allow jam disposal is further provided with a transferring body separating member that, as the fixing unit is extracted, separates the transferring body from the image carrying body.

Thus, jam disposal can be performed without breaking a sheet and without splashing unfixed toner on a sheet.

By rotatably building the transferring body separating member, it is possible to simply construct the jam disposal mechanism.

The transferring body separating member may be driven by force applying means, or may be driven electrically by the use of a motor or the like.

Moreover, the jam disposal mechanism constructed as described can be built by sharing part of the components conventionally existing in an image forming apparatus. Thus, according to the present invention, an image forming apparatus can be built with a reduced number of components and with a simple construction.

What is claimed is:

1. An image forming apparatus comprising:

an image carrying body;

a transferring body for transferring a toner image formed on said image carrying body to a sheet;

first force applying means for keeping said transferring body in pressed contact with said image carrying body at a predetermined angle;

a fixing unit for fixing the toner image transferred to the sheet by said transferring body, said fixing unit being so arranged as to be extractable substantially parallel to a paper conveying direction in order to allow jam disposal;

a transferring body separating member that, as said fixing unit is extracted, selectively takes one of a first position where said transferring body separating member separates said transferring body from said image carrying body against a force applied by said first force applying means and a second position where said transferring body separating member keeps said transferring body in pressed contact with said image carrying body.

2. The image forming apparatus of claim 1, wherein, in said first position, said transferring body separating member separates said transferring body from said image carrying body in a direction substantially opposite to a direction in which said first force applying means applies the force.

3. The image forming apparatus of claim 2, wherein said transferring body separating member is coupled to a second force applying means that applies to said transferring body a force that causes said transferring body to tend to move apart from said image carrying body, the force applied by said second force applying means being stronger than the force applied by said first force applying means, and, as said fixing unit is extracted, said second force applying means makes said transferring body separating member move into said first position.

4. The image forming apparatus of claim 3, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

5. The image forming apparatus of claim 4, wherein said transferring body separating member moves to said first position while pressing part of a bracket portion supporting said transferring body.

6. The image forming apparatus of claim 3, wherein said transferring body separating member moves to said first position while pressing part of a bracket portion supporting said transferring body.

7. The image forming apparatus of claim 2, wherein said transferring body separating member is so supported as to be rotatable about an axis parallel to a rotation axis of said transferring body, said transferring body separating member is coupled to a second force applying means that applies to said transferring body separating member a force that causes said transferring body separating member to tend to move to said first position, the force applied by said second force applying means is so set that, when said transferring body separating member moves to said first position, a moment of the force that said second force applying means applies to said transferring body separating member is greater than a moment of the force that said first force applying means applies to said transferring body separating member, and, as said fixing unit is extracted, the force applied by said second force applying means makes said transferring body separating member rotate to move into said first position.

8. The image forming apparatus of claim 7, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

9. The image forming apparatus of claim 8, wherein said transferring body separating member moves to said first position while pressing part of a bracket portion supporting said transferring body.

10. The image forming apparatus of claim 7, wherein said transferring body separating member moves to said first position while pressing part of a bracket portion supporting said transferring body.

11. The image forming apparatus of claim 2, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

12. The image forming apparatus of claim 11, wherein said transferring body separating member moves to said first position while pressing part of a bracket portion supporting said transferring body.

13. The image forming apparatus of claim 2, further comprising:

driving means for driving said transferring body separating member;

detecting means for detecting whether or not said fixing unit is extracted; and a control section for controlling said driving means based on a detection signal from said detecting means, and wherein, based on said detection signal, said control section places said transferring body separating member selectively in one of said first and second positions.

14. The image forming apparatus of claim 13, wherein said transferring body separating member moves to said first position while pressing part of a bracket portion supporting said transferring body.

15. The image forming apparatus of claim 2, wherein said transferring body separating member moves to said first position while pressing part of a bracket portion supporting said transferring body.

16. The image forming apparatus of claim 1, wherein said transferring body separating member is coupled to a second force applying means that applies to said transferring body a force that causes said transferring body to tend to move apart from said image carrying body, the force applied by said second force applying means being stronger than the force applied by said first force applying means, and, as said fixing unit is extracted, said second force applying means makes said transferring body separating member move into said first position.

17. The image forming apparatus of claim 16, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

18. The image forming apparatus of claim 17, wherein said transferring body separating member moves to said first position while pressing part of a bracket portion supporting said transferring body.

19. The image forming apparatus of claim 16, wherein said transferring body separating member moves to said first position while pressing part of a bracket portion supporting said transferring body.

20. The image forming apparatus of claim 1, wherein said transferring body separating member is so supported as to be rotatable about an axis parallel to a rotation axis of said transferring body, said transferring body separating member is coupled to a second force applying means that applies to said transferring body separating member a force that causes said transferring body separating member to tend to move to said first position, the force applied by said second force applying means is so set that, when said transferring body separating member moves to said first position, a moment of the force that said second force applying means applies to said transferring body separating member is greater than a moment of the force that said first force applying means applies to said transferring body separating member, and, as said fixing unit is extracted, the force applied by said second force applying means makes said transferring body separating member rotate to move into said first position.

21. The image forming apparatus of claim 20, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

22. The image forming apparatus of claim 21, wherein said transferring body separating member moves to said first position while pressing part of a bracket portion supporting said transferring body.

23. The image forming apparatus of claim 20, wherein said transferring body separating member moves to said first position while pressing part of a bracket portion supporting said transferring body.

24. The image forming apparatus of claim 1, wherein said fixing unit is fitted with a rail that allows said fixing unit to be extracted, and when said fixing unit is not extracted, said transferring body separating member makes contact with an end of said rail so as to be held in said second position and, when said fixing unit is extracted, said transferring body separating member loses contact with the end of said rail so as to move to said first position.

25. The image forming apparatus of claim 24, wherein said transferring body separating member moves to said first position while pressing part of a bracket portion supporting said transferring body.

26. The image forming apparatus of claim 1, further comprising:

driving means for driving said transferring body separating member;

detecting means for detecting whether or not said fixing unit is extracted; and a control section for controlling said driving means based on a detection signal from said detecting means, and wherein, based on said detection signal, said control section places said transferring body separating member selectively in one of said first and second positions.

27. The image forming apparatus of claim 26, wherein said transferring body separating member moves to said first position while pressing part of a bracket portion supporting said transferring body.

28. The image forming apparatus of claim 1, wherein said transferring body separating member moves to said first position while pressing part of a bracket portion supporting said transferring body.

* * * * *